US006375020B1

(12) United States Patent
Marquez

(10) Patent No.: US 6,375,020 B1
(45) Date of Patent: Apr. 23, 2002

(54) CAP SYSTEM FOR ALUMINUM AND/OR STEEL BOTTLES

(75) Inventor: Eugenio Roures Marquez, Badalona (ES)

(73) Assignee: Cebal Entec, S.A., Badalona (ES)

( * ) Notice: Subject to any disclaimer, the term of this patent is extended or adjusted under 35 U.S.C. 154(b) by 0 days.

(21) Appl. No.: 09/614,105

(22) Filed: Jul. 12, 2000

(30) Foreign Application Priority Data

Jul. 12, 1999 (ES) ..... 9901552

(51) Int. Cl.[7] ..... B65D 39/00
(52) U.S. Cl. ..... 215/232; 220/258
(58) Field of Search ..... 215/232, 262, 215/274, 210, 113, 382, 330, 331, 263, 40, 43; 220/258, 319, 359, 254, 780, 643, 646, 648, 669, 674

(56) References Cited

U.S. PATENT DOCUMENTS 3,899,096 A * 8/1975 Marco ..... 215/31
5,562,226 A * 10/1996 Valyi et al. ..... 220/258
5,634,567 A * 6/1997 Hekal ..... 220/359
6,010,026 A * 1/2000 Diekhoff et al. ..... 220/288

* cited by examiner

*Primary Examiner*—Lee Young
*Assistant Examiner*—Lien Ngo
(74) *Attorney, Agent, or Firm*—Darby & Darby

(57) ABSTRACT

Improved cap system for aluminum and/or steel bottles, consisting of a plastic cap adapted to the neck of an aluminum and/or steel bottle, including its placing procedure and securing. The edge of the cap acts as a contact surface for closing and sealing the bottle by thermofusion. The outside cap (1) has an inside edge (2) with small teeth (10) on its surface, underneath its upper end (3), resulting in the contact surface for closing and sealing the bottle (8) or container by thermofusion. The thickness of the bottle is reduced at the end zone (4) of its neck (9), facilitating its deformation and ensuring the attachment of the cap on the neck (9) of the bottle by means of introducing a suitable mold (5) by pressure. Thus, the cap cannot be moved between projections (6) of the bottle and inside ribs (7) of the cap.

10 Claims, 7 Drawing Sheets

CAP SYSTEM FOR ALUMINUM AND/OR STEEL BOTTLES

The present invention is directed to an improved cap system for aluminum and/or steel bottles consisting of a plastic material cap that fits on to the neck of the aluminum or steel bottle in order to facilitate their sealing or leaktightness by adhesive means that could not be easily attached to the aluminum or steel material itself.

Therefore, this invention will be of special interest for the metallic container manufacturing industry, specifically in aluminum and/or steel, as well as for plastic material accessories in general.

The problems solved by the purpose of this invention lie in the difficulty of hermetically closing the mouth of the metallic bottles by adhesive means. This characteristic makes the use of aluminum or steel bottles difficult in certain applications, for example the bottling of foodstuff where the quality of the closing system is fundamental.

On the other hand, the mentioned adhesive sealing means of bottles by thermofusion are of common use as they especially adapt well to the closing necessities of plastic containers, which have been generally accepted during the last years basically due to their highly competitive cost.

However, another type of container, such as aluminum, which is able to be reused, or steel can also be competitive as they provide certain benefits, such as mechanical resistance or durability in the face of external agents, whilst the plastic containers do not have these characteristics.

In spite of this, one of the problems that has not been solved in a satisfactory way is the closing system, as it is not possible to apply certain sealing means by thermofusion in aluminum and/or steel containers which are applicable in plastic containers. Therefore, this invention intends to present an original solution, consisting in the creation of a plastic material cap which, together with a certain shape of the neck of an aluminum and/ or steel bottle, permits it to be placed and secured by means of a simple automated mechanical procedure, that is, it can be controlled by process control electronic devices such as sequencers or programmable robots. In this way the aluminum and/or steel bottle or container can be closed and sealed by thermofusion just like a plastic bottle.

The mentioned plastic material cap placed on the neck of the bottle is made of a plastic material cover with an inside diameter similar to the outside diameter of the neck of the bottle, formed by a projecting inside edge underneath the upper end of the cap. On the other hand, the thickness of the bottle walls is reduced at the upper end of the neck of the bottle near the mouth in order to permit its easy deformation once the mentioned plastic cap has been inserted. The end of the neck of the bottle may be deformed on the above described inside edge of the cap by inserting a suitable mold under pressure through the mouth.

In this way, the edge of the neck of the aluminum and/or steel bottle is expanded on top of the inside edge of the plastic material cap which is retained and pressed on the area of the shoulders of the bottle.

The resulting seal is completely leaktight between the aluminum and/or steel bottle and the plastic material cap due to the joint under pressure produced between the mentioned internal edge of the plastic material cap and the end area of the neck of the bottle, once this has been deformed by the previous mold inserted under pressure. This is obtained precisely due to the design of the cap, in which teeth have been provided on the contact surface between the previous inside edge and the end area or neck of the bottle so that the degree is leaktightness reached is complete.

The described cap defines an upper edge completely smooth of a plastic material that replaces the one of the original neck of the bottle. This can be easily used for applying elements and closing and sealing systems of the adhesive type by thermofusion, such as those used traditionally with plastic material bottles, without this entailing that the material used in manufacturing bottles (aluminum and/or steel) can cause any inconvenience in relation to the suitable closing and sealing method or system.

Likewise, in order to prevent the plastic material cap turning on the neck of the bottle, this has various outward projections consisting in punches made through the inside of the neck of the bottle that are fastened between the inside ribs of the cap arranged longitudinally on its internal face to reinforce its own structure.

In this way, the described plastic material cap is perfectly fastened to the neck of the aluminum and/or steel bottle and cannot be turned or removed, forming a leaktight joint between the end of the neck of the bottle and the plastic material end of the cap on which the closing and sealing by thermofusion can be carried out as if it were a plastic bottle.

The following is a detailed description of the proposed improved cap system for aluminum and/or steel bottles, making reference to the enclosed drawings in which a preferred performance subject to all detail variations that do not entail a basic change in the essential characteristics of said improvements is represented purely for non-limiting information purposes.

The following is shown in said drawings.

Figure 1:
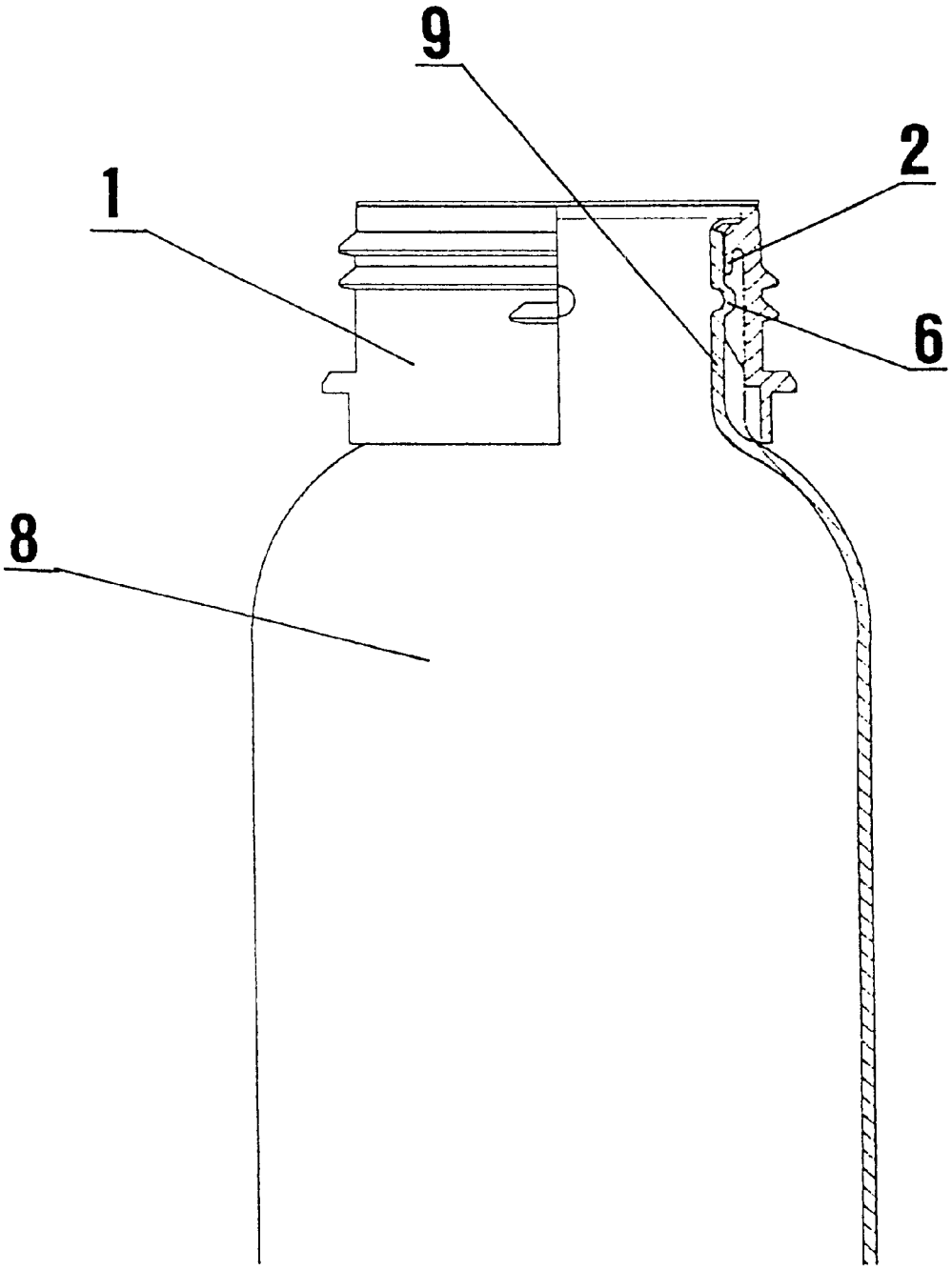
FIG. 1 represents a semi-section elevated view with the bottle and crown in the mounting position.
Figure 2:
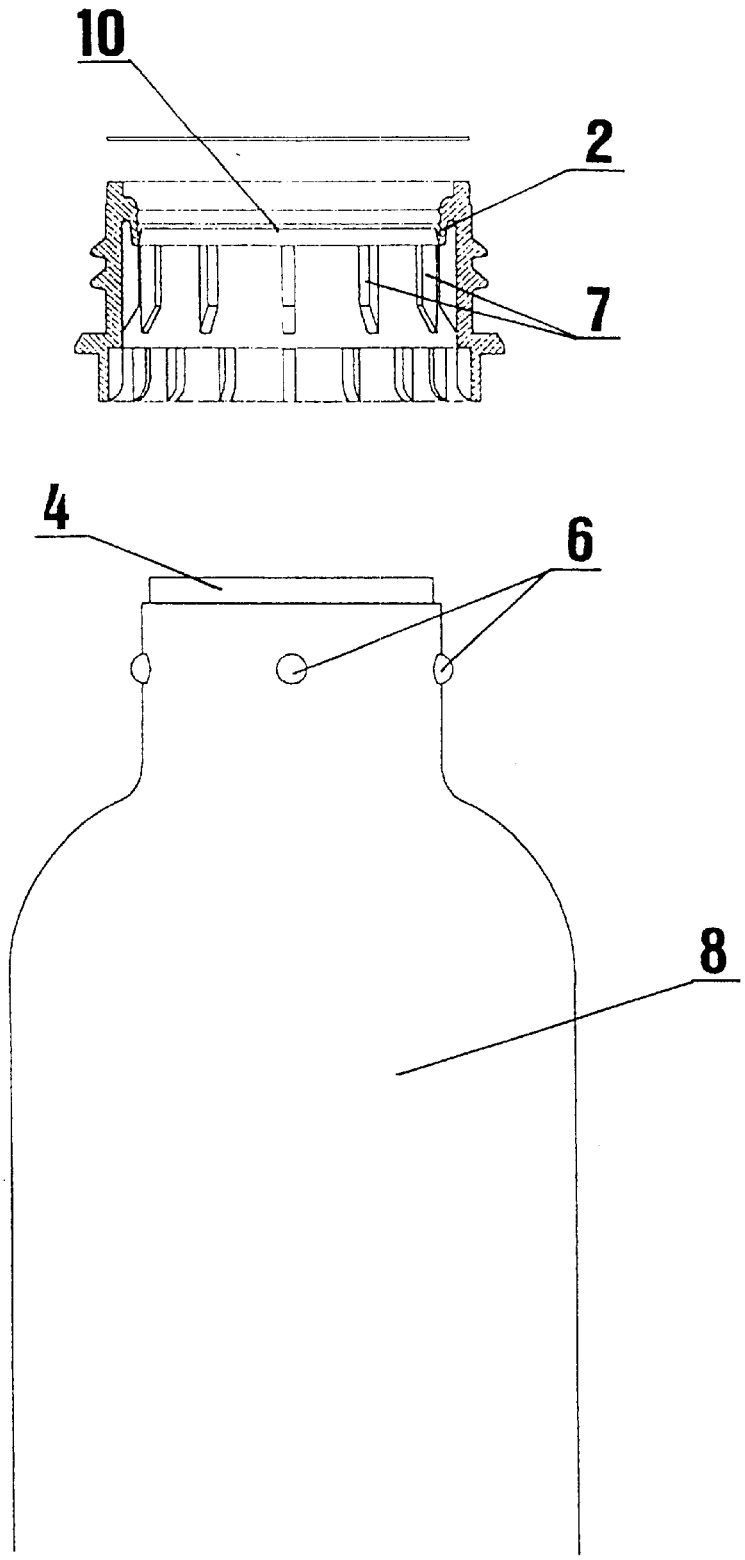
FIG. 2 shows an elevated view of the bottle with a transversal section detail of the cap.
Figure 3:
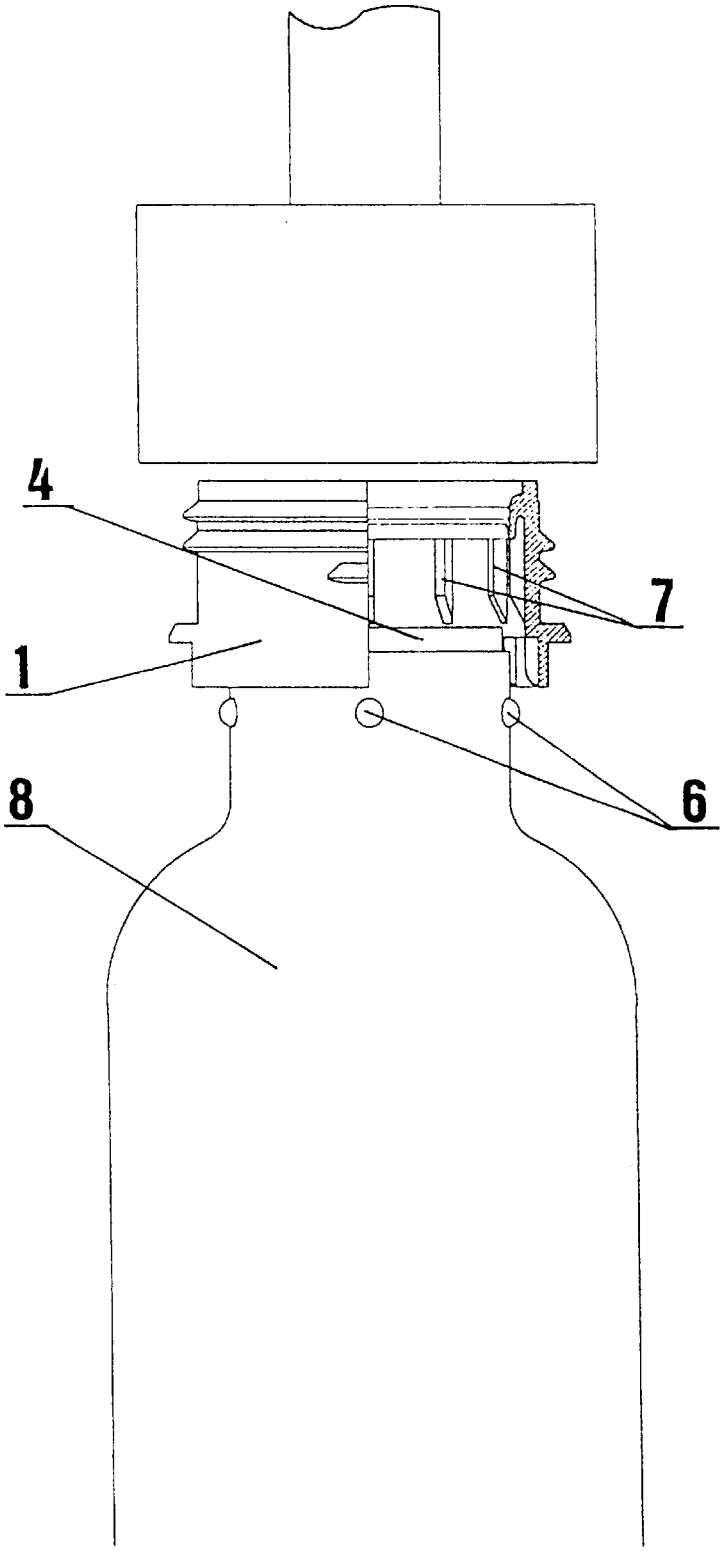
FIG. 3 shows an elevated view of the bottle with the cap being placed by means of pressing.
Figure 4:
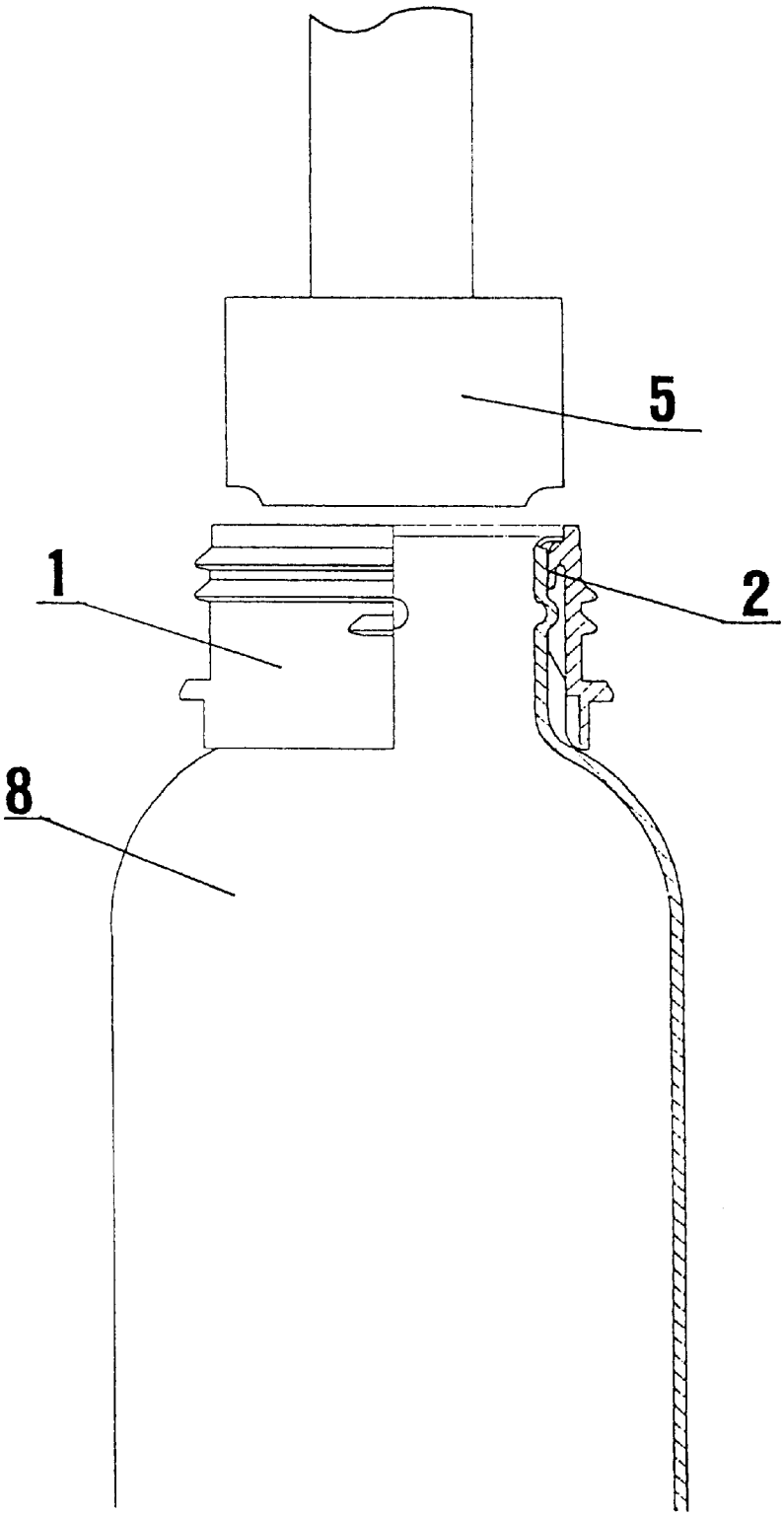
FIG. 4 shows an elevated view of the bottle with the cap being placed by means of pressing and a view of the mold used.
Figure 5:
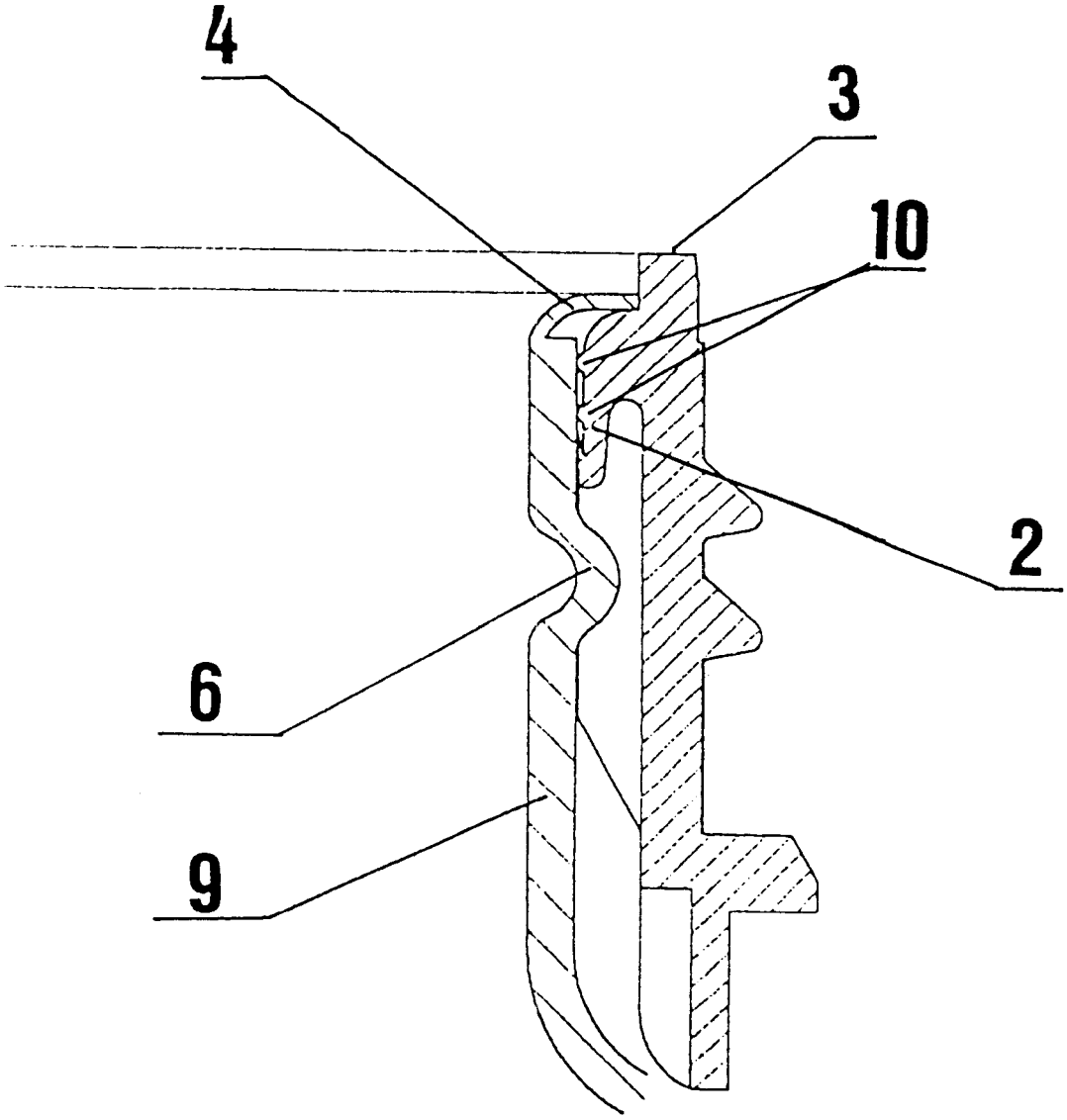
FIG. 5 represents a detail section of the union of the edge of the bottle on the internal edge of the cap.
Figure 6:
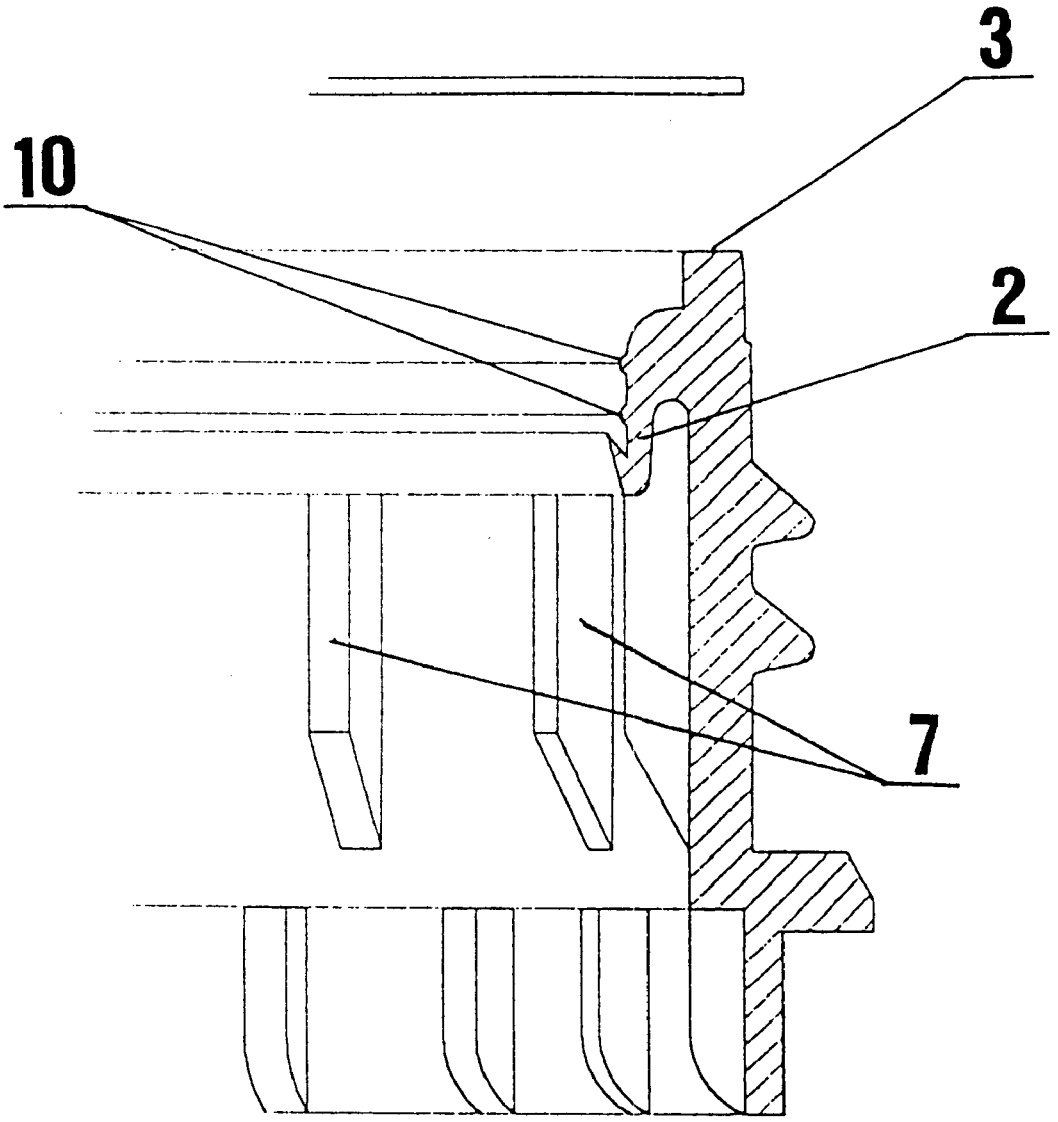
FIG. 6 shows a perspective detail section of the internal edge of the cap.
Figure 7:
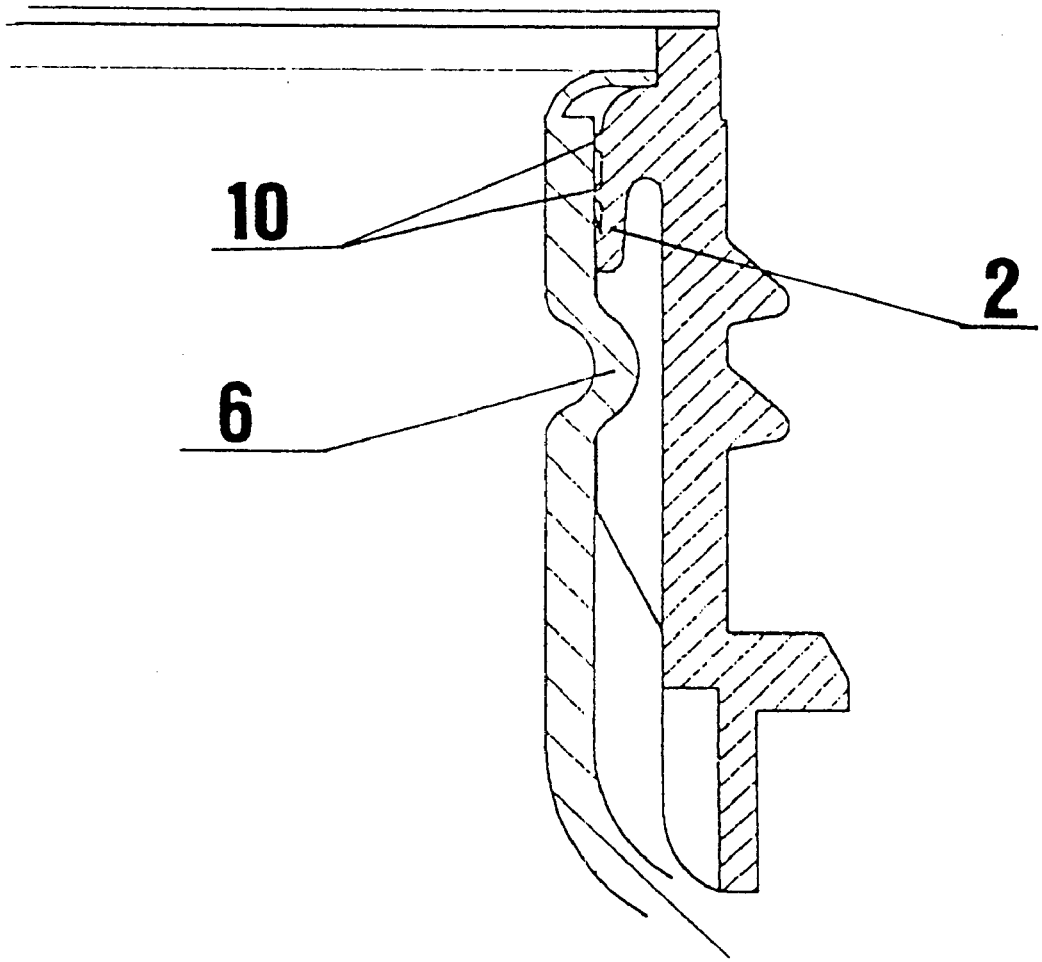
FIG. 7 represents a detail section of the union of the edge of the bottle on the internal edge of the crown with the adhesive lid.

According to the performance example shown, the improvements in the improved cap system for aluminum and/or steel bottles to which this invention refers are formed by the creation of a new and original idea of a plastic material cap, adapted to the sizes and shaped of the neck of an aluminum and/or steel bottle, including its placing and securing procedure by means of mechanical embedment under pressure. The edge of the cap serves as a contact surface for closing and sealing by thermofusion the aluminum and/or steel bottle or container with adhesive means. The mentioned plastic material cap (1), made up of a cylindrical cover with an inside diameter similar to the outside diameter of the neck (9) of the bottle (8), is formed by an inside edge (2) provided with teeth (10) on its upper surface with a projecting fold underneath the upper end (3) of the same cap, resulting in the contact surface base for closing and sealing the bottle or container (8) by thermofusion.

On the other hand, the thickness of the bottle walls is reduced on the upper end area (4) of its neck, near the mouth thus facilitating its deformation, with the mentioned plastic material cap inserted in the described inside edge of the cap, resulting in the securing of the cap on the neck (9) of the bottle.

Likewise, deformation of the walls in the area of the end of the neck (9) of the bottle on the described inside edge of the cap is made by inserting a suitable mold (5) under pressure through the mouth.

Furthermore, the described cap has a completely smooth upper edge (3) of plastic material to be used as the component application base and closing and sealing systems by thermofusion. On the other hand, the neck (9) of the bottle has various outward projections (6) consisting in punches made through the inside of the neck of the bottle that are fastened between the inside ribs (7) of the cap arranged longitudinally on its internal face to reinforce its own structure, thus preventing the plastic material cap from turning on the neck (9) of the bottle.

Finally, its shape, materials and sized could be variable and, in general, all accessories and secondary parts, provided they do not alter or modify the principle of the improvements described above.

What is claimed is:

1. Improved cap system for a metal bottle, said system comprising: a plastic cap adaptable to any size and shape neck of the metal bottle, the cap being securable by mechanical embedment under pressure; an edge of the cap serves as a contact surface for closing and sealing by thermofusion the metal bottle with adhesive; the cap formed by a cylindrical cover with an inside diameter similar to the outside diameter of the neck of the bottle, the cap formed by an inside edge with a projecting fold underneath the upper end of the cap forming a contact surface for closing and sealing the bottle or container by the thermofusion, the inside edge being adapted to receive a radially outward deformed portion of the neck of the bottle.

2. Improved cap system according to claim 1, wherein the bottle has walls reduced in thickness in an upper end area of its neck, near a mouth of the bottle to facilitate deformation of the walls, the cap is insertable in the inside edge of the cap and provided with teeth on its upper surface to secure the cap on the neck of the bottle and form a leakproof interface therebetween.

3. Improved cap system according to claim 1, wherein the cap has a completely smooth upper edge of plastic material.

4. Improved cap system according to claim 1, wherein the neck of the bottle has punches forming outward projections from inside of the neck of the bottle and fastened between inside ribs of the cap arranged longitudinally on its internal face to provide reinforcement and prevent the plastic material cap from turning on the neck of the bottle.

5. Method for using an an improved cap system for a metal bottle having a mouth, said system including a plastic cap adaptable to any size and shape neck of the metal bottle, the cap formed by a cylindrical cover with an inside diameter substantially equal to an outside diameter of the neck of the bottle, the cap formed by an inside edge with a projecting fold underneath an upper end and extending longitudinally in the cap substantially parallel to the neck of the bottle forming a contact surface, said method comprising the steps of:

placing the cap on the mouth of the metal bottle;

securing the cap to the neck of the metal bottle by mechanical embedment under pressure so that the inside edge of the cap receives a radially outward deformed portion of the neck of the bottle; and sealing the contact surface of the cap to the bottle by thermofusion with adhesive.

6. The method according to claim 5, wherein the cap has teeth on its upper surface to secure the cap on the neck of the bottle and form a leakproof interface therebetween, and the bottle has walls reduced in thickness in an upper end area of its neck, near its mouth.

7. The method according to claim 6, wherein said securing step comprises deforming the reduced thickness walls of the bottle on to the inside edge of the cap.

8. The method according to claim 7, wherein said deformation step comprises inserting a mold under pressure through the mouth of the bottle.

9. The method according to claim 5, wherein the cap has a completely smooth upper edge of plastic material.

10. The method according to claim 5, wherein the neck of the bottle has punches forming outward projections from inside of the neck of the bottle and fastened between inside ribs of the cap arranged longitudinally on its internal face to provide reinforcement and prevent the plastic cap from turning on the neck of the bottle.

* * * * *